United States Patent [19]

Hoffman

[11] 4,090,762

[45] May 23, 1978

[54] ELECTRICAL TERMINAL CONNECTION AND METHOD OF MAKING SAME

[75] Inventor: Ernest Gerhard Hoffman, Middlefield, Conn.

[73] Assignee: Harvey Hubbell, Incorporated, Orange, Conn.

[21] Appl. No.: 760,309

[22] Filed: Jan. 18, 1977

[51] Int. Cl.[2] ..... H01R 11/20

[52] U.S. Cl. ..... 339/95 R; 339/246; 339/266 R; 339/270 R

[58] Field of Search ..... 339/95 R, 95 D, 97 R, 339/97 P, 98, 241, 242, 243, 246, 248, 249, 263 R, 264, 266 R, 270 R

[56] References Cited

U.S. PATENT DOCUMENTS

| | | | |
|---|---|---|---|
| 1,363,350 | 12/1920 | Recker | 339/249 R |
| 1,489,835 | 4/1924 | Kietz | 339/246 |
| 1,979,091 | 10/1934 | Alsaker et al. | 339/246 |
| 2,304,711 | 12/1942 | Shenton | 339/95 R |
| 2,712,167 | 7/1955 | Blanchard | 339/246 |
| 3,068,445 | 12/1962 | Crowther | 339/246 |
| 3,793,607 | 2/1974 | Smith et al. | 339/263 R |

FOREIGN PATENT DOCUMENTS

| | | | |
|---|---|---|---|
| 239,431 | 10/1911 | Germany | 339/246 |
| 596,119 | 4/1934 | Germany | 339/263 R |
| 906,714 | 3/1954 | Germany | 339/266 R |
| 2,052,388 | 8/1971 | Germany | 339/246 |
| 2,142,930 | 3/1973 | Germany | 339/97 R |

*Primary Examiner*—Joseph H. McGlynn

[57] ABSTRACT

A terminal connection which will accept electrical conductors of various sizes and provides oxide breaking, spring loading, and conductor confining and bundling features. A tab or finger on one of the terminal elements presses the conductor regardless of its size toward the other terminal element, and oxide breaking edges on one of the elements break oxide coatings on the conductor while the tab or finger both confines the conductor and forces it toward a mechanical operator such as a screw. Forcing the conductor toward the screw reduces offset loading and permits additional oxide breaking by scraping the conductor with the screw as the screw is rotated to tighten the terminal. In the case of a stranded conductor, the bundling obtained by forcing the conductor toward the screw assures good interstrand electrical contact, so that the electrical resistance at the connection is not significantly different from the resistance of a corresponding solid conductor. In several embodiments, the tab or finger provides the spring loading or spring follow required to maintain good electrical and mechanical characteristics of the connection. In some embodiments, a struck-out leg provides spring loading and the biting action for oxide breaking.

9 Claims, 42 Drawing Figures

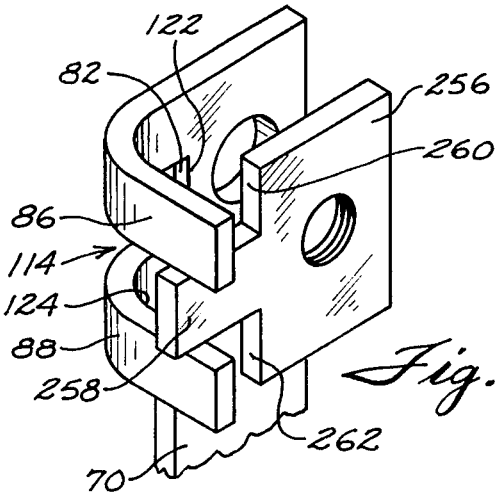
Fig. 25
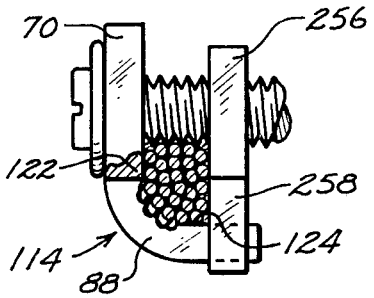
Fig. 26
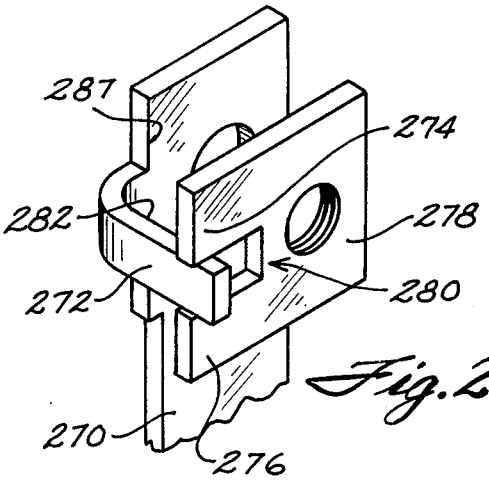
Fig. 27
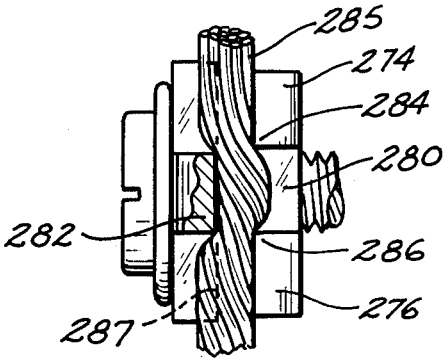
Fig. 28
Fig. 29
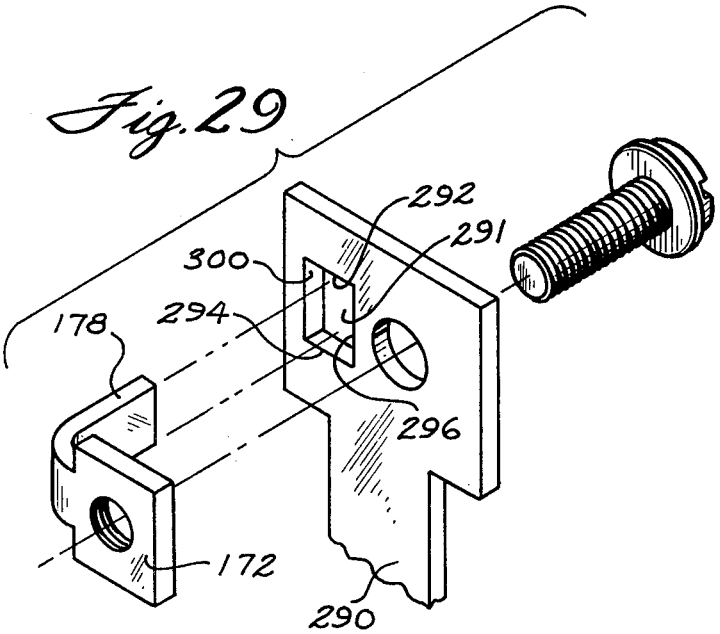
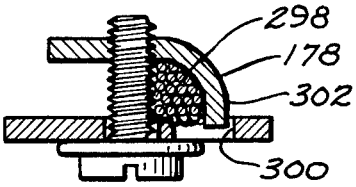
Fig. 30

ELECTRICAL TERMINAL CONNECTION AND METHOD OF MAKING SAME

This invention relates to an electrical connection having unique electrical and mechanical characteristics for connecting a solid or stranded electrical conductor to a terminal. The invention also relates to a unique method of connecting a solid or stranded conductor to a terminal to attain an excellent mechanical and electrical connection which is long lasting and reliable.

More particularly, the invention relates to what is commonly termed a "backwired terminal", with unique oxide breaking and wire confining and clamping characteristics which insures a low electrical resistance and good mechanical connection and which retains its low electrical resistance virtually indefinitely, and to a method of making such a connection.

A widely used terminal for connecting a wire or conductor is the so called "backwired type". The backwired terminal includes essentially, a screw, a current carrying terminal plate, and a clamping nut. In many such backwired terminals, the terminal plate has a clearance opening to receive the screw, and the screw is threaded into the clamping nut to draw the clamping nut toward the terminal plate when the screw is tightened. In the conventional backwired terminal, the electrical connection is made by inserting the stripped end of an insulation jacketed conductor between the clamping nut and the terminal plate and then tightening the screw to compress the conductor between the clamping nut and the plate. Such backwired terminals are quite popular because of the ease of connecting a conductor to the terminal, and because the terminal assembly can be surrounded with electrically insulating barriers.

The terminal should be designed to accept conductors of various sizes. This is because the same sized terminal parts may be employed in terminals of different current ratings to reduce manufacturing costs of the wiring device on which the terminals are mounted and to account for the general field practice of using different size conductors in the same type of wiring device. Hence, in a 20 ampere wiring device which would normally call for #12 wire, it is common industry practice to design for one conductor size larger (#10 wire) to compensate for voltage drops in relatively long conductors and for one size smaller (#14 wire) which is adequate for relatively short conductors or for loads at the 16 ampere level. The size of #14 stranded wire is approximately 0.073 inch, the size of #12 stranded wire is approximately 0.095 inch and the size of #10 stranded wire is approximately 0.116 inch. Thus, the cross-sectional area of the conductor from 190 14 to #10 varies from about 0.004 inch to 0.101 inch, or about 250 percent. Since the user cannot be expected to change the geometry of the wire, the terminal must then have an opening large enough to accept the diameter of the largest wire and yet, ultimately provide the necessary high clamping forces to a given conductor regardless of its size.

In prior art terminal connections of which I am familiar, the contact surfaces which are driven against the conductor to compress the conductor and thereby make electrical contact therewith and move only in one plane. I have observed that such a terminal will allow a degree of freedom to the conductor, after the connection is made, sufficient for the conductor to change its position in the terminal and thereby undesirably increase the electrical resistance of the connection.

Another disadvantage of such terminals is that the terminal clamping portion of the clamping nut is cantilevered from the screw. The cantilevering of this portion of the clamping nut creates high internal thread loads which results in relatively low mechanical efficiency in transforming the screwdriver torque, when the screw is tightened, into conductor clamping loads. In addition, as the screw is tightened, the clamping nut often tilts with respect to the terminal plate so that the nut itself exerts an outward component of force on the conductor which tends to force the conductor from between the nut and terminal plate. In an effort to prevent a solid or stranded conductor from being pushed outwardly or sideways from between the terminal plate and clamping nut, electrical insulating material barriers are frequently provided. Such barriers typically take the form of ribs located on either side of the clamping nut but may cold flow under sustained loading sufficiently to allow outward or sideway strand displacements.

In addition, in a practical wiring device, the female contacts are allowed a measure of freedom to move relative to the insulating barriers to facilitate the alignment with mating male contacts. This freedom allows relative motion between the insulating barrier and the clamped conductor and can result in a loosening of the conductor with attendant reduction in reactive forces at the terminal plate.

Problems of cantilevering and tilting of the clamping nut and any barrier softening or movement of the terminals parts relative to the barrier have an additional undesirable effect in the case of a stranded conductor. Any such movement of the conductor with respect to the terminal parts permits micromovements among the individual strands, and as a result of such movements, still fewer strands are in contact to carry the current at the connection. Moreover, the micromovements expose previously clamped surfaces to the atmosphere to be oxidized, thus increasing the terminal resistance.

Two additional disadvantages of prior art backwired terminals are (1) the generally poor oxide breaking characteristics of the terminal on the conductor, and (2) the absence of a positive spring follow or spring action on the conductor after the terminal is tightened. Both these features are significant where the conductor has an oxide coating, which if not broken at the time the terminal is made, results in a high resistance connection. Spring follow is particularly important when the conductor is a stranded conductor. In such cases when compressive terminal loading occurs for extended periods of time, the strands may shift and occupy a smaller volume than occupied previously. This "settling" of the strands tends to reduce the effective cross-sectional area of the conductor and if the loading members are substantially fixed in position, then the contact pressure will decrease due to a decrease in the clamping loads which are effectively applied to the conductor.

In accordance with this invention, there is provided a terminal suitable for use with various sized conductors, which can be of the backwired type, and which avoids the disadvantages and problems of the prior conductor connecting terminals. More particularly, in accordance with the terminal connection and the conductor connection method of this invention, the terminal plate and nut are so arranged and associated with each other that the conductor is continually urged inwardly toward the screw as the screw is tightened, so the effect of offset loading on the nut and terminal plate is minimized.

Importantly, the plate and nut confine the conductor featured to urge all confined surfaces thereof inwardly in an optimum manner toward the screw as the screw is tightened, thereby permitting the use of the same terminal with both stranded and solid conductors of various wire sizes. In addition, as the screw is tightened, there is a biting and/or scraping action of the conductor by the screw, the nut, and/or the terminal plate so that excellent oxide breaking and conductor cleaning occurs.

Where the conductor is of the stranded type, it is important that good interstrand contact be attained at the terminal connection such that the electrical resistance of the stranded conductor at the terminal connection is essentially the same as the electrical resistance of a corresponding solid conductor. Such interstrand contact at the connection is attained as a result of the inward compression of the stranded conductor by the plate and/or nut, as the terminal screw is tightened so the various, substantially helically disposed conductor strands are compressed inwardly thereof or "bundled" by the terminal parts. As a result of such bundling of a stranded conductor when the terminal is tightened, the electrical characteristics at the terminal connection approximate the electrical characteristics of a terminal connection with a corresponding solid wire. The interstrand contact is maintained as a result of the spring follow characteristics of the terminal connection.

Also, the arrangement of the nut and terminal plate is such that the conductor is resiliently clamped so that a spring follow or resilient pressure acts on the connected conductor.

In accordance with one embodiment of the terminal plate element and nut element of this invention, a curved finger on one of these elements extends through a slot or opening in the other of the elements, the slot being of a width approximately the width of the finger so that there is a "punch and die" effect where the finger upsets the conductor into the opening during final tightening of the screw. This punch and die effect provides superior oxide breaking, and the curvature of the finger cams the conductor inwardly toward the screw which reduces the cantilevering forces applied to the nut thereby improving the electrical efficiency of the connection. The tab or finger, by virtue of its selected width, which is narrower than the body portion of the element from which it extends, possesses resiliency to deflect somewhat in a direction parallel to the axis of the screw as well as in a direction transverse to the axis of the screw. This action maintains a spring loading on the conductor to compensate for conductor displacement. The tab or finger also assures simple assembly and ease of operation by engaging an edge of the slot or opening to prevent rotation of the nut when the screw is turned. Where the conductor is stranded, the tab and/or finger hugs the conductor to bundle it so that good interstrand contact is attained at the connection.

In accordance with one method of this invention, a superior low resistance connection is attained by forcing the conductor inwardly toward a mechanical device, such as a screw which tightens the connection, and by engaging the conductor with a sharp edge to break oxide during tightening of the mechanical device. The method can also include resiliently clamping the conductor against the sharp edge while resiliently maintaining the conductor confined, and maintaining good interstrand contact where the conductor is of the stranded type.

Correspondingly, it is an object of this invention to provide a unique electrical terminal connection which will accept various sized electrical conductors in which a portion of the terminal connection bites into or scrapes the conductor during tightening of the connection, and in which the conductor is confined against movement from between nut and terminal portions of the connection.

An additional object is a terminal connection including a screw for tightening a nut with respect to a terminal plate, where the nut and terminal plate securely clamp the conductor resiliently, urge the conductor toward the screw, and drive the conductor into a recess or opening having a sharp edge which breaks oxide and/or corrosion on the surface of the conductor.

An additional object is a unique terminal and nut arrangement in which a finger on either the terminal or nut forces the conductor toward a sharp edge to cause the edge to bite the conductor as the nut is tightened, where the finger also confines the conductor against movement away from the screw which tightens the nut.

An additional object is a terminal connection in accordance with one or more of the preceding objects in which there is inter-engagement between the terminal and the nut to prevent rotation of the nut as the screw or other mechanical device is tightened to clamp the conductor.

Another object is a terminal connection in accordance with one or more of the preceding objects, in which the sharp edged opening is of limited depth to prevent severing the conductor, while assuring a good biting action into the conductor to obtain a low resistance connection.

Another object is a terminal connection with a struck-out leg, that can have a sharp edge, where the conductor is engaged by the leg to resiliently deflect the leg during tightening of the connection, thereby spring loading the connection to resist deterioration with age.

Another object is a terminal connection in which a tab or finger cams a stranded conductor toward the terminal screws and hugs and bundles the conductor to assure good interstrand contact of the conductor at the connection.

Numerous other objects, features and advantages of this invention will become apparent with reference to the accompanying drawings and the description of the preferred embodiments.

BRIEF DESCRIPTION OF THE DRAWINGS

FIG. 25 is a pictorial view of another embodiment of terminal connection;

FIG. 26 is a top plan view showing the clamping action of the terminal connection of FIG. 25 on a conductor;

FIG. 27 is a pictorial view of another embodiment of the terminal connection;

FIG. 28 is a front view in elevation with portions cut away showing the clamping action of the terminal connection of FIG. 27;

FIG. 29 is a pictorial view of another embodiment of the terminal connection;

FIG. 30 is a top plan view showing the clamping action of the terminal connection of FIG. 29;

DESCRIPTION OF PRIOR ART

Figure 1:
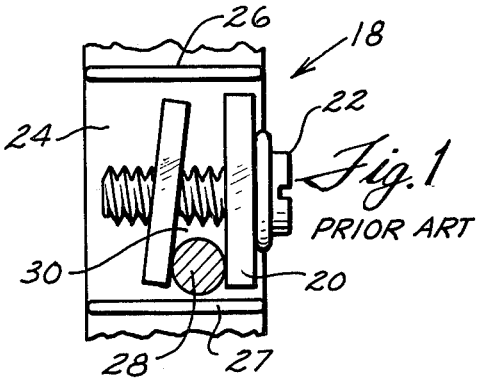
Fig. 1 PRIOR ART
FIG. 1 is a partial view in plan of a prior art backwired terminal clamping a solid conductor.
Figure 2:
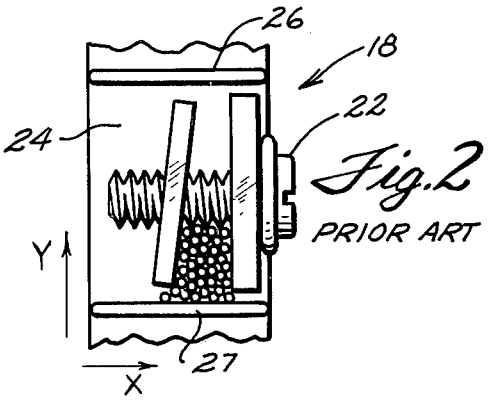
Fig. 2 PRIOR ART
FIG. 2 shows the prior art connector of FIG. 1 clamping a stranded conductor.

FIGS. 1 and 2 show a typical prior art backwired terminal 18. Such terminals typically include a terminal plate 20, a screw 22, extending through a clearance opening in the terminal plate, and a square or rectangular clamping nut 24 into which the screw is threaded. The terminals can have insulating barriers in the form of ribs 26, 27 at the sides of terminal plate 20 and nut 24. As screw 22 is tightened, the conductor 28 which is offset with respect to the line of action of the screw tends to tilt the nut (in a clockwise direction as viewed at FIG. 1). In the typical connector, there is tilting of the screw at the clearance opening at the terminal plate 20, there is tilting of the nut on the screw, and there is some deflection of the opposed portions of the nut and terminal plate which engage the conductor. While such tilting is minimized if the conductor is maintained in the region 30, close to the threaded portion of screw 22, it is difficult to hold the conductor in the region 30 while tightening the screw. As a result of the tilting of the nut on the screw, the clamping action is mechanically inefficient and thus, one does not achieve maximum available clamping force. The tilting of nut 24 results in a component of force on the conductor 28, and which tends to force the conductor sideways from between the nut 24 and terminal plate 20, toward insulating barrier 27. Any conditions which cause or permit movement of the conductor enable the conductor to move toward the barrier 27, and the clamping pressure is reduced.

Where the conductor is stranded, as shown at FIG. 2, the terminal tends to flatten the conductor, but the nut also tilts so there is a component of force acting to force the conductor sideways from between the nut and the terminal plate. Any outward movement of the stranded conductor decreases both the clamping pressure between the terminal and the conductor, and interstrand contact of the conductor. As a result, the connection tends to deteriorate, and can fail where the insulating barrier yields to permit the conductor to move a substantial distance sideways.

Figure 3:
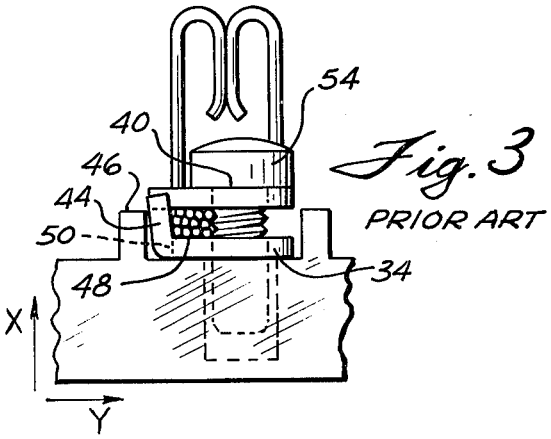
Fig. 3 PRIOR ART
FIG. 3 is a front view in elevation of another prior art connector.
Figure 4:
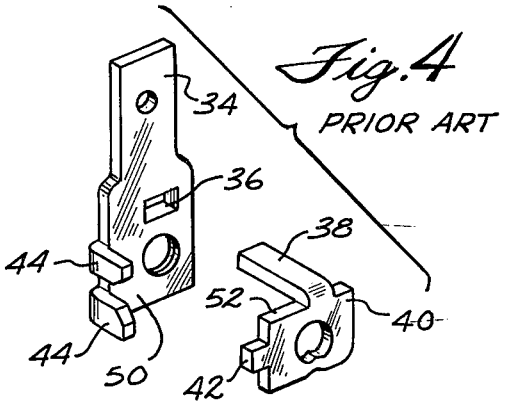
Fig. 4 PRIOR ART
FIG. 4 is a pictorial view of the prior art connector of FIG. 3.

FIGS. 3 and 4 illustrate a prior art construction which attempts to alleviate some of the problems of the backwired terminal. FIGS. 3 and 4 are respectively, FIGS. 2 and 5 of U.S. Pat. No. 2,687,517. As shown at FIG. 4, the connector includes a terminal plate 34 with a rectangular opening 36 to receive tongue 38 of a clamp element 40. The clamp element has a tab 42 which extends laterally into the space between parallel fingers 44 on terminal plate 34. As shown at FIG. 3, fingers 44 join terminal plate 40 at a sharp right angle bend, and an insulating barrier 46 prevents outward flexing of the fingers 44 away from the screw. While this prior art arrangement of FIGS. 3 and 4 is somewhat successful in confining the conductor, there is no spring action or spring follow. It is stated in the specification of U.S. Pat. No. 2,687,517 that the arm 38 is a very close fit in opening 36 to prevent tilting of clamp element 40, and since fingers 44 cannot flex outwardly, there can be no spring loading. In addition, it can be seen from FIGS. 3 and 4, that tab 42 does not engage conductor 48. Conductor 48 is clamped between the flat body portions 50 and 52 of the respective terminal plate and clamp element. Since fingers 44 extend at essentially a right angle to the body of terminal plate 34, with tab 42 wholly between the fingers, there is no force acting to press the conductor against any edge of the terminal, there is no force exerted by the tab to coin or push the conductor into the slot between fingers 44, and there is no scraping of the conductor. Correspondingly, there is no oxide breaking or scraping action on conductor 48 as the screw 54 is tightened. The fingers 44 do not force conductor 48 inwardly toward screw 54, but at best confine the conductor to prevent the conductor from moving outwardly as the conductor is flattened when the screw 54 is tightened.

Moreover, in both these prior art terminals, wherein the X and Y dimensions are assumed to have been originally established by the size of the largest stranded conductor to be used in the device on which the terminal connection is mounted, if a smaller diametered stranded conductor is inserted into the terminal as conductor 28 and only the X dimension changes as the clamping nut 24 acts against the conductor, the strands are then flattened out with very little interstrand reaction. Also, as settling occurs while the terminal connection is in use, the strands may become loose since the Y dimension which was predicated on the greater diameter of the largest wire now allows strands to be displaced into the available space thereby reducing the mechanical and electrical integrity of the connection.

DETAILED DESCRIPTION OF PREFERRED EMBODIMENTS

Figure 7:
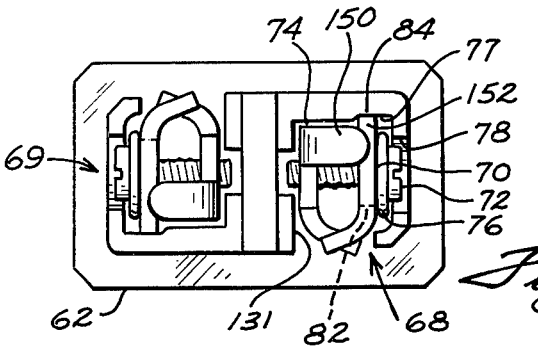
FIG. 7 is a top plan view of the plug and terminal connection of FIG. 5.

FIGS. 5–8 show one embodiment of the terminal connection of this invention in the environment of a plug assembly 60. As shown, plug assembly 60 is of the type used at the end of an extension cord or appliance cord, to connect an electrical device to a conventional wall socket. Plug assembly 60 includes a base 62 molded from an insulating material, and having a pair of plug prongs 64, 66 which extend through and are molded into the base 62, to fix the plug prongs to the base. At the upper end of the respective plug prongs, (as best seen at FIG. 7), are identical terminal assemblies 68 and 69, in accordance with one embodiment of this invention. Terminal assembly 68 includes a terminal element 70 integral with the upper portion of its associated plug blade 66. Extending through an opening 71 (FIG. 8) in the terminal element is a screw 72 which is threaded into a threaded opening 73 in a clamp element or nut 74 so that the clamp element is moved toward the terminal element when screw 72 is rotated in the proper direction.

Screw 72 has a head with a flange 76, which is disposed within an arcuate recess 77 (FIGS. 5–7) defined in part by a curved rib 78 integral with base 62 and which overlaps the flange 76 along slightly more than 90° of the circumference of the flange. Rib 78 prevents separation of screw 72 from terminal element 70, by acting as a stop to prevent withdrawal of the screw if it is unthreaded from clamp element 74.

Terminal element 70 is advantageously formed from a single piece of flat metal stock of uniform thickness, by punching and bending. The terminal element has a flat body portion 80 which is generally rectangular, as defined between its side edges 82 and 84. Integral with the body are fingers 86 and 88 which are parallel, and which are each bent so that corresponding portions of the fingers are coplanar with each other. Each finger is bent along a long radius bend 90 (in contrast with a sharp right angle bend) and the ends 92 and 94 of the fingers face generally toward nut element 74. The radius 90 is preferably somewhat greater than the radius of the largest diameter conductor to be connected by the connector assembly, and is also preferably greater than the thickness of the metal from which terminal element 70 is formed. The bend in fingers 86, 88 can be as much as 90°, but is preferably somewhat less than 90°, for example, on the order of 85°, so that a major portion of the inside surface 96 of each finger faces toward and is at an acute angle with respect to the line of action of screw 72. By virtue of this arrangement, a substantial portion of the inside surface 96 of each finger is located outwardly of edge 82 of the terminal element, as is apparent from FIGS. 7 and 8.

The nut or clamp element 74 is also formed from sheet metal stock of uniform thickness, by stamping and bending. Nut element 74 has a generally rectangular body 98 with a continuous side edge 100, and a side edge having coplanar portions 102, 104. There is also a top edge 106. A tab 108, integral with nut element 74 at edge 102, 104 is bent along a long radius bend 108 to project toward terminal element 70. The long radius bend 108 is preferably of the same radius as the long radius bend 90 of the fingers 86, 88, and this bend can be as great as 90° but is preferably on the order of 85°. The height of tab 108 as measured between its side edges 110 and 112 is only slightly less than the height of slot 114 as measured between the facing edges 116, 118 of the respective fingers 86 and 88 so that the tab 108 can extend into the slot 114 and between fingers 86 and 88. Such construction enables the tab and fingers to overlap in the manner shown at FIG. 7.

Figure 6:
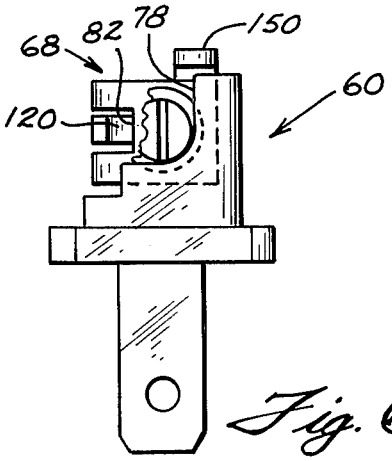
FIG. 6 is a side view in elevation of the plug and terminal connection of FIG. 5.

When the connector is assembled, with screw 72 connecting the nut element 74 to terminal element 70, edge 82 of the terminal element is generally coplanar with edge portions 102 and 104 of the nut element. By virtue of this construction, a substantial portion of the inside surface 120 of the tab 108 is opposite the slot 114, as shown at FIG. 6.

The inside corner 122 of edge 82 is made sharp. The inside corner 124 of edge 118 of finger 88 is also sharp along its length from edge 82 to tip 94 of the finger. The corresponding inside corner of finger 86 is also sharp. As will soon be explained, these sharp corners function to scrape and bite into a conductor between the terminal and nut as the terminal is tightened, to break any existing oxide on the conductor.

The inside corners 126 of tab 108 of the nut element are preferably rounded to avoid a shearing action between corners 126 of the tab and corners 124 of the fingers, and thus minimize the possibility of severing the conductor.

FIGS. 9–12 show the action of connector assembly 68 as the connection is tightened to securely clamp a solid conductor 130 inserted between nut element 74 and the terminal plate 70. By unthreading screw 72, nut 74 is moved away from terminal element 70. When the screw retaining rib 78 is provided (FIGS. 5–7), the nut is positively moved away from the terminal, and is held in an open position by the screw. The extent that the screw can be unthreaded is limited by a stop face 131 (FIG. 7) of molded base 62. As is apparent from FIG. 9, with the terminal connector open, the space 132 bounded by fingers 86, 88, the threaded portion 134 of screw 72, and the tab 108 is quite large so that conductor 130 can be inserted easily. The extent of insertion of the conductor is such that its tip extends somewhat below the lower finger 88.

Figure 10:
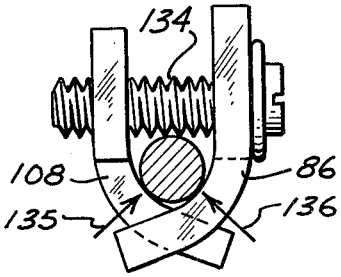
FIG. 10 is a view corresponding to FIG. 9 and showing the position of the terminal connection parts when initially engaging a conductor.
Figure 11:
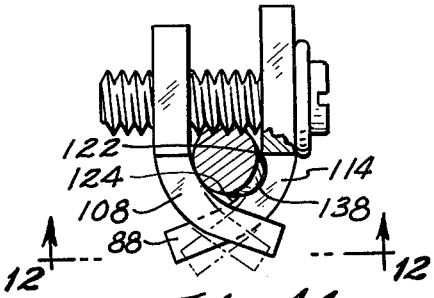
FIG. 11 is a view corresponding to FIG. 9 and showing the deforming action on a solid conductor when the terminal connection is tightened, and also showing the spring follow provided by finger and tab portions of the terminal connection.
Figure 12:
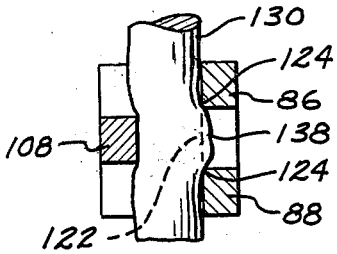
FIG. 12 is a view looking along line 12—12 of FIG. 11, but with the tab and fingers of the terminal assembly broken away for purposes of illustration, to better show the deforming of a conductor by the terminal connection when tightened.

FIG. 10 shows the connector with the screw advanced to the point where tab 108 and fingers 86, 88 have engaged conductor 130 and exert slight pressure on the conductor. As shown, tab 108 exerts a force in the direction of arrow 135, and fingers 86 exert a force in the direction of arrow 136 to urge the wire toward the body 134 of the screw. As is apparent, these forces have components acting both inwardly and in a direction parallel to the screw. There is also an inwardly directed force acting along the area of engagement of the fingers and tabs with the surface of the wire in the region between arrows 134 and 136, and which provides additional inwardly directed force. However, when conductor 130 engages screw 134, further inward movement of the conductor is resisted after the conductor is deformed into the screw threads of screw body 134. Rotation of the screw while engaged by the conductor provides cleaning and oxide breaking. Additional tightening of the connector to the position of FIG. 11 physically deforms a portion 138 of conductor 130 into the space or slot 114 between fingers 86, 88, and against both the sharp corners 124 of the fingers and the sharp corner 122 of the terminal, as shown at FIGS. 11 and 12. Such deformation occurs as a result of the component of force parallel to the axis of screw body 134 exerted by the relatively narrow tab 108 on the conductor 130 and which effectively coins the conductor against the sharp corners of the terminal element.

FIGS. 9–12 show the cleaning and oxide breaking attained with a solid conductor having a diameter approximately three times the distance 140 (FIG. 9) between the crest of the threads on screw body 134, and the corner 122 of edge 82 of the terminal element. When the screw 72 is tightened to the extent shown at FIG. 11, conductor 130 is deformed. However, regardless of how tight the screw is tightened, conductor 130 cannot be severed or sheared off, since the inside faces of the terminal element 70 and the nut element 74 between the periphery of the screw body 134 and the respective edges 82 and 102, 104 respectively will clamp a substantial portion of the conductor. During final tightening of screw 72, both the tab 108 and fingers 86, 88 tend to deform outwardly (as shown in phantom lines at FIG. 11), and such deformation is resilient. This action provides a substantial spring loading, both inwardly toward screw body 134, as well as in a direction parallel to the axis of screw 72. Such spring force or spring loading prevents deterioration of the connection by maintaining high clamping forces if settling of the conductor strands were to take place.

Figure 13:
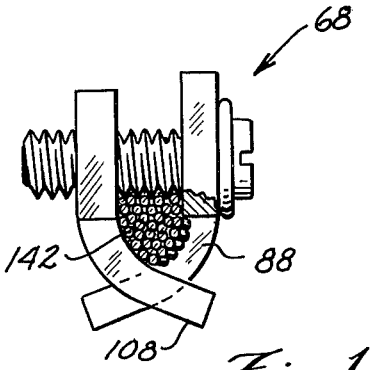
FIG. 13 is a view corresponding to FIG. 11 and showing the action of the terminal of the embodiment of FIGS. 5–8, on a stranded conductor.

FIG. 13 shows the final tightened position of connector assembly 68 when a stranded conductor 142 is clamped at the connection. In the case of stranded conductor 142, the individual strands of the conductor are tightly pressed against each other to attain good interstrand contact. The sharp corners of the fingers have scraped the surface of some strands of the wire, with strands of the wire adjacent screw body 134 having been abraded by the screw. The conductor 142 itself is partly upset into the space 114 between the fingers. There is in addition, spring loading or spring follow exerted by both the fingers and the tab on the now confined and compacted stranded conductor 142.

Because of the inwardly directed forces from the fingers and tab, which cam the stranded conductor toward the screw, the strands are bundled and hugged at the connection. The cross-sectional configuration of the conductor does not change appreciably from its original circular section, since the bundling minimizes flattening of the conductor. Hence, the characteristics of the connection with a stranded conductor approximate those attained with a solid conductor. Since the individual strands are tightly bundled, the resistance of the stranded conductor, at the connection, is essentially the same as other portions of the conductor remote from the connection, and there is good electrical contact between the terminal parts and the conductor. The spring follow or spring loading exerted by the fingers and tab assure a long lasting low resistance connection, and provide continued clamping if the individual strands settle.

As shown at FIGS. 5–8, extending from the top edge 106 of nut element 74 is a guard tab 150. This guard tab extends over the top edge 152 of the terminal element and is of sufficient length to extend across the edge 152, at any operational position of screw 72. As shown at FIG. 7, guard tab 150 completely blocks and therefore prevents inadvertently inserting a conductor into the region on the opposite side of the screw from the tab and fingers. Correspondingly, the guard tab 150 eliminates the possibility of improperly using connector assembly 68.

It will be noticed from FIG. 7 that the side edge 74 of the nut is relieved slightly inwardly of the side edge 84 of the terminal element. This enables the side of the terminal element to extend slightly into recess 77 thereby strengthening the molded material which forms rib 78, so that screw 72 cannot be withdrawn.

Figure 5:
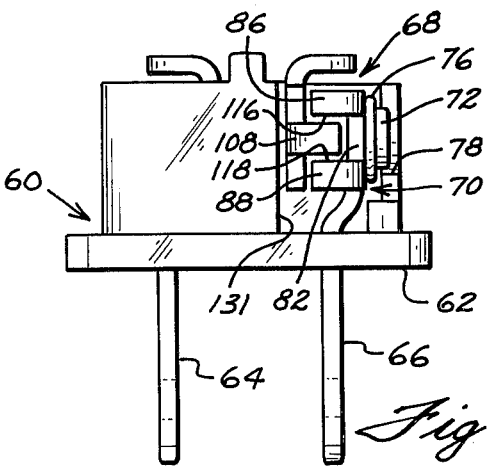
FIG. 5 is a front elevational view of a plug assembly including one embodiment of the terminal connection of this invention.
Figure 8:
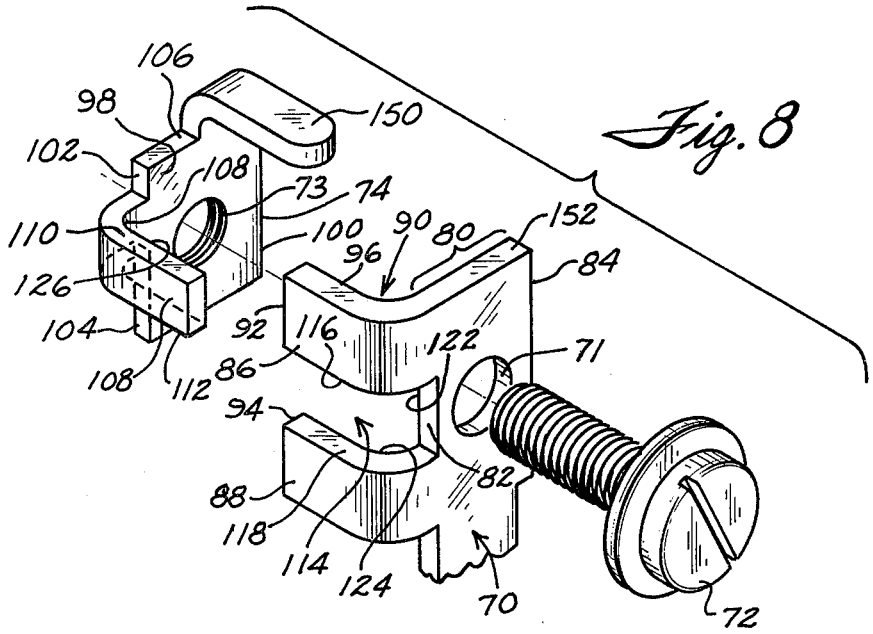
FIG. 8 is an enlarged pictorial view of the embodiment of terminal element shown at FIG. 5, with portions removed for clarity of illustration.

As is apparent from FIGS. 5, 6 and 8, tab 108 is guided along the inside edges 116 and 118 of the fingers, both during tightening and loosening of screw 72, so nut element 74 cannot rotate.

Figure 14:
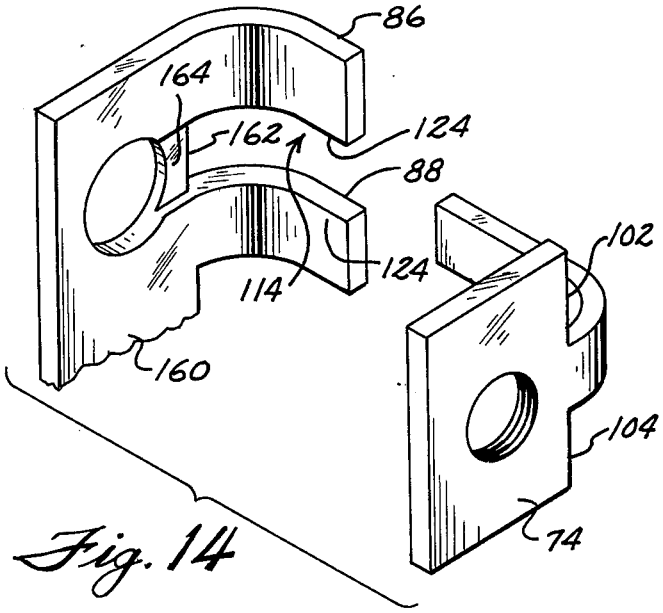
FIG. 14 shows another embodiment of the terminal connection of this invention.
Figure 15:
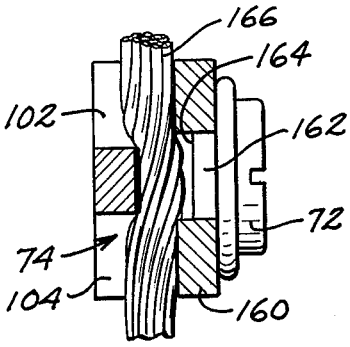
FIG. 15 is a front view in elevation of the terminal connection of FIG. 14, with portions broken away, to show the coining and deforming action on a conductor, when the terminal connection is tightened.

FIGS. 14 and 15 show a variation of the embodiment of FIGS. 5–8. As shown, there is a terminal element 160 which has fingers 86 and 88 of the same construction and configuration as the terminal element 70. There is therefore a space or slot 114 between the fingers and into which the tab of the nut element 74 can extend. Fingers 86 and 88 have sharp inner corners 124 and the terminal element 160 has a side edge 162 between fingers 86 and 88. In this embodiment, a recess 164, which forms a continuation of slot 114, is formed in the section of the terminal element between edge 162 and the periphery of clearance opening 71. Such construction enables the sharp corners 124 of the fingers to extend to the periphery of opening 71. Otherwise, terminal 160 is identical to terminal 70.

In the terminal 160 of FIG. 14, the conductor or wire is coined into the recess 164, when the connector is tightened, as shown at FIG. 15. As is apparent from FIG. 15, a conductor 166 between nut element 74, and terminal element 160 is deformed into recess 164 when screw 72 is tightened. The upsetting of the conductor into recess 164 occurs as a result of the action of the body portion of nut 74 between edge 102, 104 and the perimeter of threaded opening 73. Hence, in the embodiment of FIGS. 14 and 15, there is upsetting of the wire into recess 164. In addition, there is some upsetting or coining of the wire into the portion of slot 114 outwardly of edge 162, in the manner previously described with reference to FIGS. 12 and 13. However, there is no danger of severing the conductor because it is the flat body portion of the nut element between edge 102, 104 and the periphery of threaded opening 73 which exerts the direct force on the wire in opposed relation to the recess during final tightening of the terminal. The fingers 86, 88, the tab 108 exert the same spring follow described with reference to FIG. 11.

Figure 16:
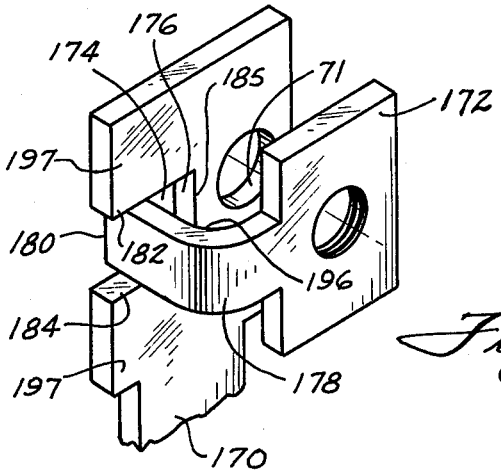
FIG. 16 is a pictorial view showing another embodiment of the terminal connection.

FIG. 16 shows another embodiment of the terminal assembly. As shown at FIG. 16, there is a flat terminal plate 170, and a nut 172. Formed in one side of terminal 170 is a slot 174 which opens through one side of the terminal plate. The slot originates at an edge 176 spaced from the perimeter of clearance opening 71. Nut 172 has a tab 178 bent along a long radius bend, so the end 180 of the tab projects through slot 174. The tab 178 is quite similar to tab 108 of the embodiment of FIGS. 5–8, but is somewhat longer than the tab 108. Corners 182 and 184 of slot 174 are sharp, and corner 185 of edge 176 is also sharp.

Figure 17:
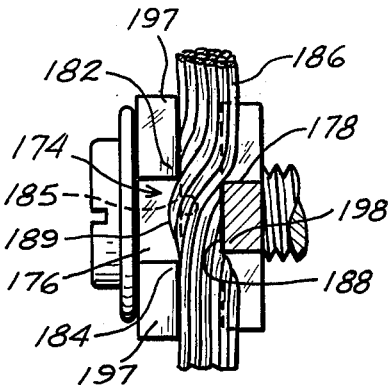
FIG. 17 is a front view in elevation, of the terminal connection of FIG. 16, with portions broken away to show the coining and deforming action on a conductor.
Figure 18:
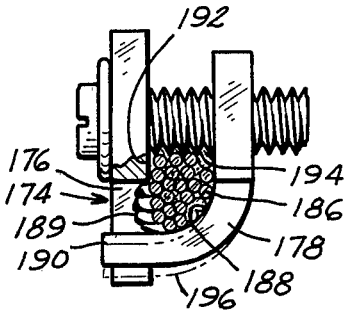
FIG. 18 is a top plan view of FIG. 17 with portions broken away to show the action of the terminal connection on a conductor.
Figure 9:
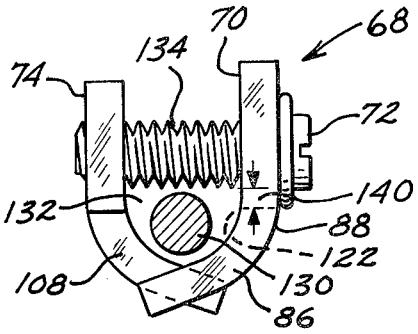
FIG. 9 is a top plan view of the terminal connection of FIGS. 5–8 showing the position of the terminal parts to receive a conductor.

When the terminal assembly of FIG. 16 is tightened, a conductor 186 is driven against corners 182 and 184 of the slot and against corner 185 of slot 176, by the inside surface 188 of tab 178, as shown at FIGS. 17 and 18. There is also some upsetting of a portion 189 of the conductor into the region of the slot between edge 176 and the end portion 190 of the tab. In this embodiment, the single tab 178 forces the conductor both inwardly toward the screw, to confine the conductor, as well as in a direction parallel to the axis of the screw to attain good coining of the wire against the sharp corners 182, 184 and 185, and to deform a portion 189 of the wire into slot 174. Opposed surfaces 192 and 194 of the body portions of the respective terminal and nut clamp the wire and act as a stop to prevent severing the wire. As shown at FIG. 18, spring loading is attained by the action of the tab 178 during final tightening of the screw. Such spring action occurs as a result of resilient outward deformation of the tab as shown by phantom lines 196, as well as slight flexing of the fingers 197 of terminal plate 170, at opposite sides of the slot 174. The inside corners 198 of tab 178 can be sharp to provide additional abrading and oxide breaking as the terminal is tightened.

Figure 19:
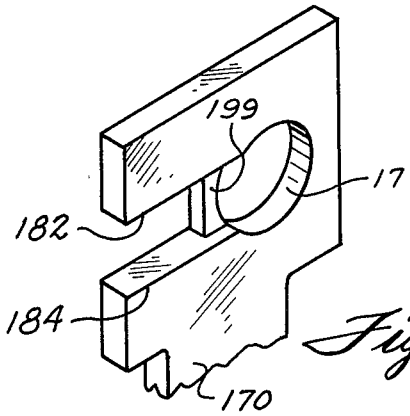
FIG. 19 is a pictorial view showing a modification of the terminal plate of the terminal connection of FIG. 16.
Figure 20:
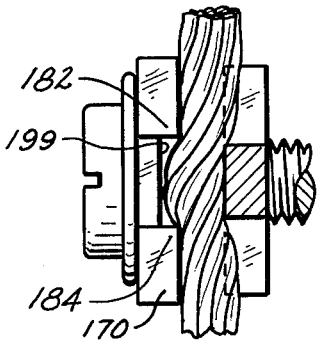
FIG. 20 is a front view in elevation showing the clamping action of the terminal connection of FIG. 19 on a conductor.

FIG. 19, shows a variation of the embodiment of FIG. 16. In this embodiment, terminal plate 170 has a recess formed between edge 176 and the perimeter of clearance opening 71. By virtue of recess 199, the sharp edges 182 and 184 extend to the perimeter of opening 71. Such construction provides for deforming conductor 186 against edges 182, 184 along a substantial portion of its width, and there is some additional deforming of the conductor into this recess 199 when the terminal is tightened. The deformation attained is generally as shown at FIG. 20, and in some instances, the force exerted by the tab is sufficient to deform the wire so that a portion of the wire bottoms against the surface of the recess 199.

Figure 21:
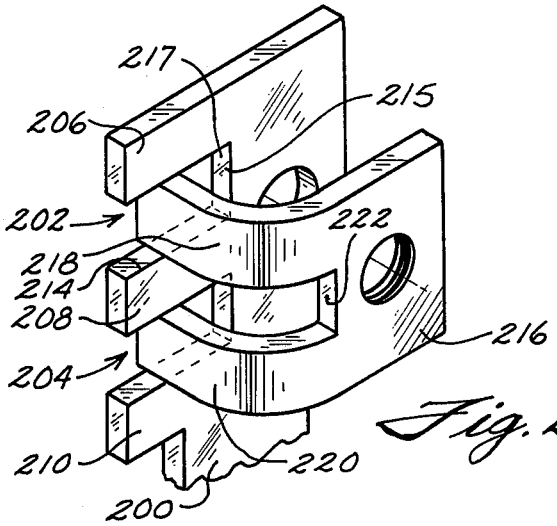
FIG. 21 is pictorial view showing another embodiment of the terminal connection.

FIG. 21 shows another embodiment. In the embodiment of FIG. 21, terminal plate 200 has slots 202 and 204 so that there are three straight and parallel fingers 206, 208 and 210 in the plane of body 212 of the terminal plate. The inside corner of each finger, such as corner 214 of each finger is sharp, and the corner 215 of the inner edge 217 of each slot is sharp. Nut 216 includes a pair of tabs 218 and 220 which curve toward the terminal plate along a long radius bend and are spaced apart and dimensioned to be received between slots 202 and 204 of the terminal plate 200. The edges 217 of the slots 202 and 204 are coplanar with edge 222 of the nut when the terminal is assembled.

The terminal assembly of FIG. 21 provides the same scraping and oxide cleaning as the embodiment of FIGS. 16–18, and the conductor is deformed into both slots 202 and 204 by the respective tabs 218 and 220. Hence, additional oxide breaking is attained by the additional slot and tab of the FIG. 18 embodiment. The spring follow results from deflection of tabs 218, 220, and slight deflection of fingers 206, 208, and 210.

Figure 22:
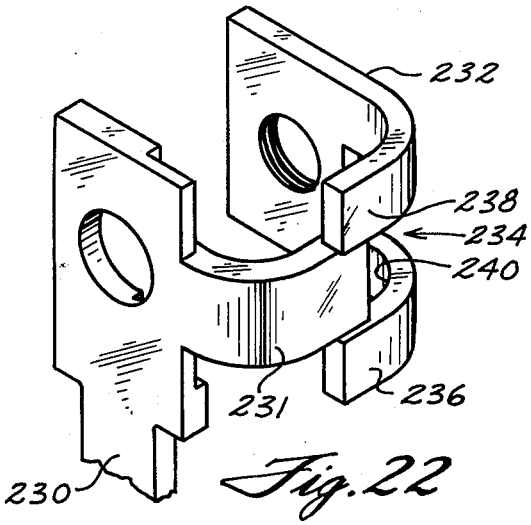
FIG. 22 is a pictorial view showing another embodiment of the terminal connection.
Figure 23:
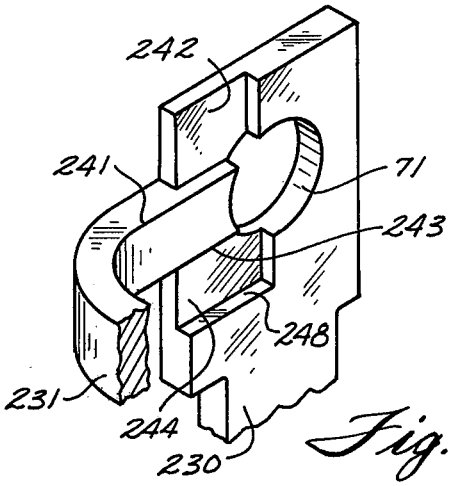
FIG. 23 is a pictorial view of the terminal plate of the connection of FIG. 22.

FIGS. 22 and 23 show another embodiment. In FIG. 22, terminal plate 230 has only one finger 231 which is curved as previously described for the embodiment of FIGS. 5–8, and nut 232 has a slot 234 between a pair of tabs 236 and 238. The inside corners 240 of tabs 236 and 238 are preferably rounded, whereas the inside corners 241, 243 of finger 231 are sharp. In this embodiment, recesses 242 and 244 are formed in body 246 of the terminal element so that edges 241, 243 extend to the periphery of clearance opening 71. If desired, corner 248 at the lower portion of recess 244 can also be sharpened.

In this embodiment, tabs 236 and 238 coin the conductor 250 into corners 241, 243 of the finger, and scraping of the conductor by the corners 241, 243 occurs during tightening of the connection. Additional oxide breaking occurs when the conductor is forced against the threaded portion of the screw during tightening of the connector.

Figure 24:
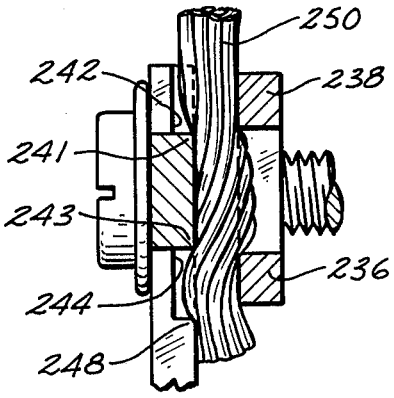
FIG. 24 is a front view in elevation, with portions cut away showing the clamping of a conductor by the terminal connection of FIG. 22.

The biting and deforming action of the connection of FIGS. 22 and 23 is shown at FIG. 24. As is apparent, tab 236 forces the conductor 250 against corners 243 and 248 so that a portion of the conductor is deformed into recess 244. In addition, a portion of the conductor is forced against edge 241 and into recess 242 by tab 238. Spring follow occurs as a result of the flexing action of tabs 236 and 238 and the finger 231, when the terminal is tightened. Such flexing action as well as confining of the wire and forcing same toward the screw, is essentially the same as that described with reference to FIG. 11.

In the embodiment of FIG. 25, there is a terminal plate 70 identical to the terminal plate of FIGS. 5–8. Coacting with the terminal plate 70 is a nut 256 with a straight tab 258 which lies in the plane of the body of the nut. The inside corners 124 of the fingers 86 and 88 are sharpened, as is corner 122 of the terminal element. Edges 260, 262, of the body of the nut, are preferably coplanar with edge 82 of the slot 114 between the fingers.

The coining and deforming of conductor 264 by the terminal of FIG. 25, when the terminal is tightened, is shown at FIG. 26. As is apparent, tab 258 deforms the conductor into the slot 114, against edges 124 of the fingers, and against corner 122 of the finger. The wire is confined during tightening of the connector, by the fingers 86, 88, and the fingers and tab 258 provide the desired spring follow characteristics.

As a variation of the connection of FIG. 25, a terminal plate 160 (FIG. 14) can be used, this terminal plate having a recess 164 so that edges 124 can extend to the perimeter of clearance opening 71.

FIG. 27 shows an embodiment where a terminal plate 270 has a single long radius curved finger 272, and there are straight tabs 274 and 276 on a nut element 278. Tabs 274 and 276 are coplanar with the body of the nut element and are defined in part by a slot 280 through which finger 272 extends. In this embodiment of FIG. 27, inner corners 282 of the finger are sharpened, whereas corners 284 and 286 of the tab are preferably rounded. As shown at FIG. 28, tabs 274 and 276 force conductor 285 against edges 282 of finger 272 as well as against the sharpened corners 287 at the side of the terminal element where finger 272 originates.

A variation of the embodiment of FIGS. 16–18 is shown at FIG. 29. In FIG. 29, a nut 172, identical to the FIG. 16 embodiment is used. Terminal plate 290 has a rectangular opening 291 to receive the tab 178 of the nut. Corners 292, 294, and 296 are sharp, and the corners of tab 178 of the nut element 172 are rounded, so the tab 178 coins a conductor 298 into the opening 291 as shown at FIG. 30. Preferably, edge 300 of opening 291 is somewhat outwardly of the outside surface 302 of tab 178 when the tab is relaxed, to enable the tab to deflect outwardly so that spring loading is attained when the connector is tightened.

Figure 31:
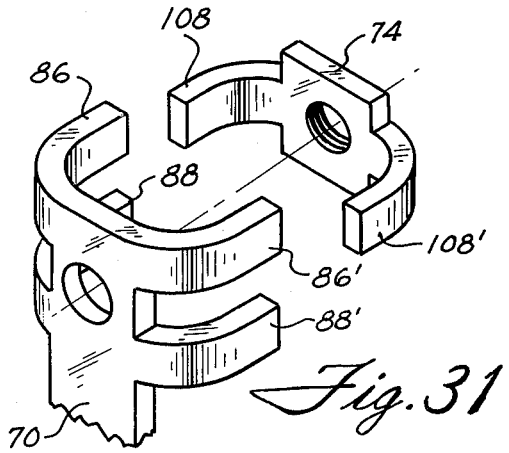
FIG. 31 is a pictorial view of a two conductor terminal connection.
Figure 32:
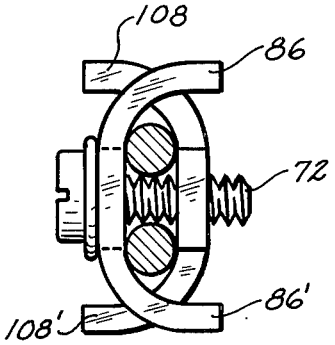
FIG. 32 is a top plan view of the terminal connection of FIG. 31 showing its clamping action.

In all the embodiments previously described in FIGS. 5–30, the terminal assembly can be of modified form to receive and connect to two conductors, rather than one. In such modified form, each of the terminal plates and each of the nut elements is bi-symmetrical about a plane passing through the center of the screw and parallel to the length of the terminal plate. An example of such a modified construction is shown at FIGS. 31, 32, which is a modification of the embodiment of FIGS. 5–8. It will be apparent from FIG. 31 that a second tab 108' has been added to nut element 74, and that there is a second pair of fingers 86' and 88' on terminal plate 70. In addition, guard bar 150 is eliminated since this arrangement accommodates two conductors, one on each side of screw 72. The coining, confining, deforming and spring loading previously described is attained where such bi-symmetrical arrangement is used.

Figure 33:
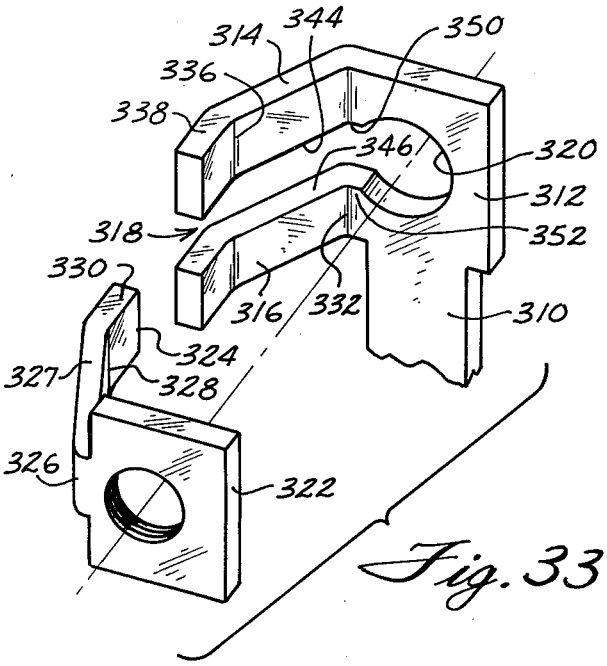
FIG. 33 is a pictorial view of another embodiment of terminal connection.
Figure 34:
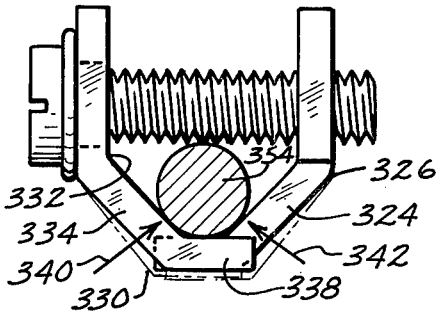
FIG. 34 is a top plan view of the terminal connection of FIG. 33 showing its clamping action on a large diameter conductor.

FIGS. 33 and 34 show another embodiment of the terminal connection. As shown at FIG. 33, terminal plate 310 has a flat body 312, and fingers 314, 316 which project from the body. The fingers are separated by a slot 318 which is narrower than and extends into clearance opening 320.

Nut 322 has a flat body and a single tab 324 which projects from the body of the nut toward terminal plate 310 and into the space 318 between fingers 314, 316. A distinct characteristic of this embodiment is the configuration of the bends in fingers 314, 316, and tab 324. As shown at FIGS. 33 and 34, a bend 326 is formed in tab 324 close to the body of nut 322 so a portion 327 of the tab extends at approximately a 45° angle with respect to the plane of the body of the nut element. A second bend 328 is formed in the tab so that the tip 330 of the tab is generally parallel with the line of action of screw 72. Fingers 314 and 316 have a configuration similar to that of tab 324. Each finger is bent along a relatively sharp bend 332 near the body 312 of the terminal to present portions 334 extending at approximately a 45° angle to the plane of the body 312, and are also bent along bends 336 to present end portions 338 generally parallel with the line of action of screw 72, and which overlap end 330 of tab 324.

The embodiment of FIGS. 33 and 34 allows the reduction of the cross-sectional area to clamp the smallest sized conductors. As is apparent from FIG. 34, the forces exerted on a large conductor by the fingers and the tab are respectively in the direction of the arrows 340 and 342. The tips 338 of the fingers, and the tip 330 of the tab confine even the large diameter wire shown at FIG. 34, and the forces from the tab and fingers force the wire against the screw and upset the wire slightly into the slot 312 between the fingers. In this embodiment, the inside corners 344 and 346 of the fingers are sharp to attain oxide breaking and some oxide breaking occurs as the screw is rotated during final tightening while the wire is forced against the screw by the fingers and tab. Spring follow results from deflection of the tab and the fingers, as shown at FIG. 34, in phantom lines.

As shown at FIG. 33, slot 318 extends into the clearance opening 320 allowing the clamping nut to move further into the slot than in the previously described embodiments to tightly clamp even the smallest sized conductors. The inner portions of the respective corners 344 and 346 of the fingers, designated 350 and 352, and which are adjacent the clearance opening are also sharp. FIG. 34 shows the action of this connector on a solid conductor 354. Such a solid conductor, of relatively large diameter, does not normally engage the edges 350, 352.

Figure 35:
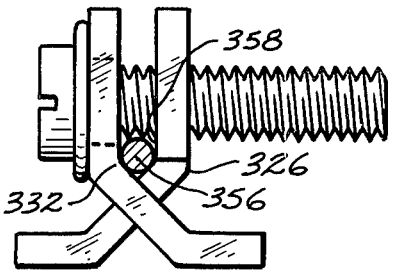
FIG. 35 is a view corresponding to FIG. 34 and showing the clamping action of the terminal connection of FIG. 33 on a relatively small diameter conductor.

FIG. 35 shows the action of the terminal assembly of FIGS. 33 and 34 on a relatively small diameter solid conductor. This conductor 356 has a diameter approximately one-third the diameter of the conductor 354 of FIG. 34. When the terminal assembly is tightened on the conductor 356, as shown at FIG. 35, the conductor is defomed and coined into the sharp edges 350, 352 as well as into the portion of slot 318 which is near bend 332. It will be observed from FIG. 35 that the bend 326 of tab 324 is generally coplanar with the bend 332 of the fingers, when the terminal is assembled. As a result, there is a relatively broad face 358 of nut element 322 in opposed relation to edges 350, 352 of terminal element 310. This face 358 prevents severing of the small diameter conductor 356 even when the terminal assembly is firmly tightened.

While not shown, it will be apparent that the embodiment of FIGS. 33–35 provides a confining and coining action on stranded conductors which can be of widely different diameter to attain a connection with excellent mechanical and electrical characteristics.

The previously described embodiments rely on some resiliency in either a tab of a nut element or a finger of a terminal plate to obtain spring loading, or spring follow. In the embodiments now to be described, spring follow, and in some instances, oxide breaking are attained as a result of a struck-out portion of the terminal element or nut body.

Figure 36:
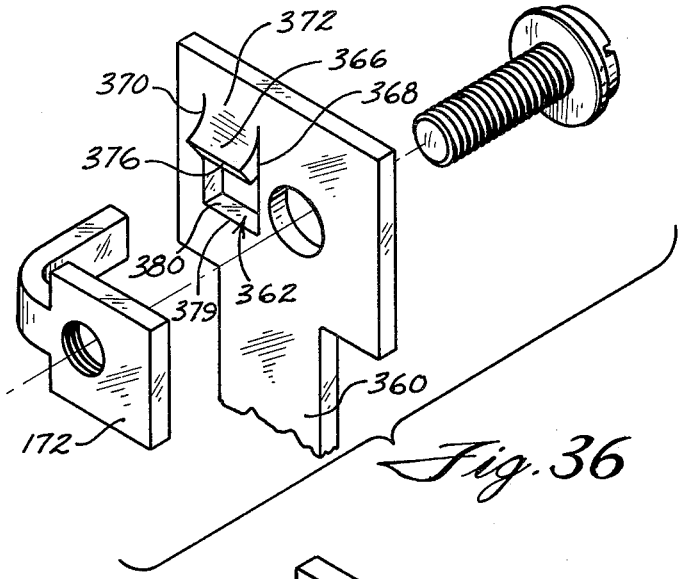
FIG. 36 is a pictorial view of another embodiment of terminal connection.

With reference to FIG. 36, terminal plate 360 has a rectangular opening 362 similar to opening 290 of the embodiment of FIG. 29. At one edge of the opening is a struck-out portion 366 which is severed or slit from the body 360 along side edges 368 and 370, but is connected to the terminal along a bend 372. Bend 372 adds resiliency to the struck-out portion 366 so that a force on its sharp corner 376 causes the portion 366 to deflect toward the plane of body 360 as the terminal is tightened.

Figure 37:
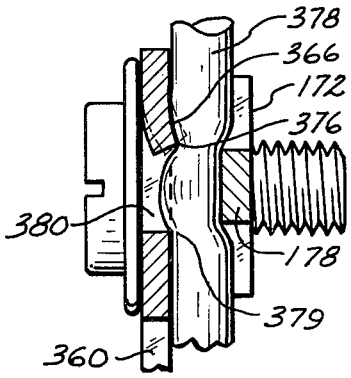
FIG. 37 is a view in section taken along line 36—36 of FIG. 37 and showing the spring loading and oxide breaking action of the terminal connection of FIG. 36.

Such action is shown at FIG. 37. When the terminal is tightened, and nut 172 moves toward terminal plate 360, tab 178 forces conductor 378 against corner 376, which causes the portion 366 to deflect inwardly toward the plane of the terminal element 360 as the connector is tightened. The sharp corner 376 provides oxide breaking, whereas the struck-out portion 366 provides spring loading in addition to that provided by the tab 178 of the nut element. Corner 379 of edge 380 of the opening can also be sharp to attain additional oxide breaking.

Figure 38:
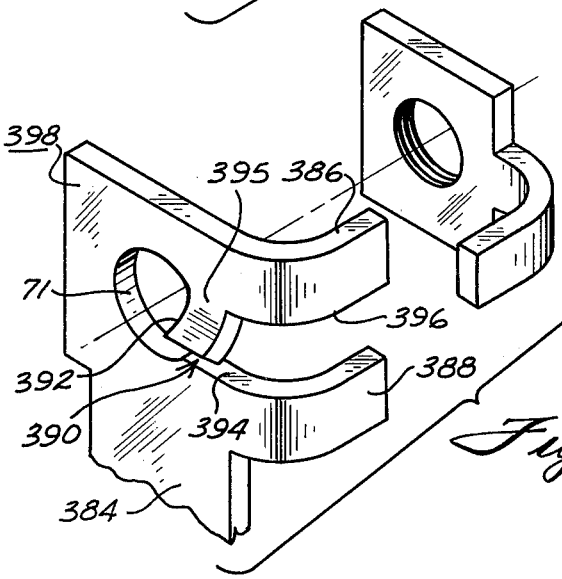
FIG. 38 is a pictorial view of another embodiment of terminal connection.
Figure 39:
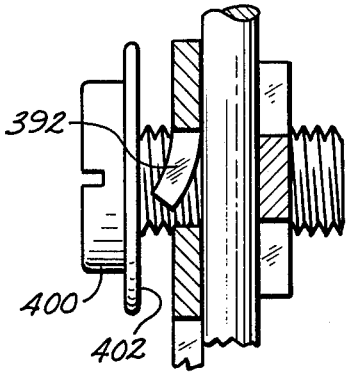
FIG. 39 is a view in section taken along line 39—39 of FIG. 38 and showing the connection with its spring loading leg relaxed.
Figure 40:
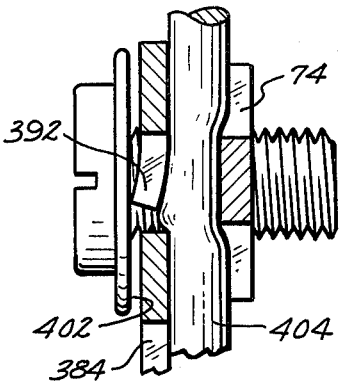
FIG. 40 is a view corresponding to FIG. 39 and showing the terminal connection tightened, and with its spring leg tensioned.

FIG. 38 discloses another spring loading arrangement. As shown at FIG. 38, terminal 384 has fingers 386 and 388 each of which has a long radius bend, as described previously. In this embodiment there is a single cut 390 which severs a leg 392 from edge 394 of finger 388. This cut extends into clearance opening 71. Leg 392 is bent along a bend line 395 coplanar with lower edge 396 of finger 386. Such bending is rearwardly toward rear surface 398 of terminal plate 384. FIG. 39 shows leg 392 in its relaxed condition, before the terminal connection is tightened. As is apparent, leg 392 is beneath head 400 of the screw, and is engaged by the under surface 402 of the head when the terminal is tightened. FIG. 40 shows the terminal tightened on a conductor 404. Tightening the screw has forced leg 392 against conductor 404, flattening the leg against the conductor. As a result, the leg 392 exerts a spring force against the underside 402 of the screw head which pulls nut element 74 toward terminal plate 384. This provides the needed and desirable spring loading or spring follow previously discussed. It will of course be evident, that when the terminal of FIGS. 38–40 is tightened, confining of the conductor 404 occurs as a result of the action of fingers 386, 388, and tab 108. In addition, there is oxide breaking against the sharpened inner edges of the fingers 386, and 388, as well as coining of the conductor into the slot between the fingers, in the manner previously described.

Figure 41:
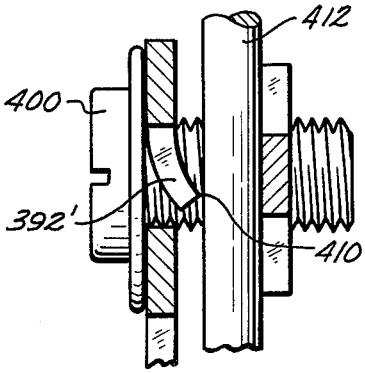
FIG. 41 is a view corresponding to FIG. 39 and showing a variation of the terminal connection of FIG. 38.
Figure 42:
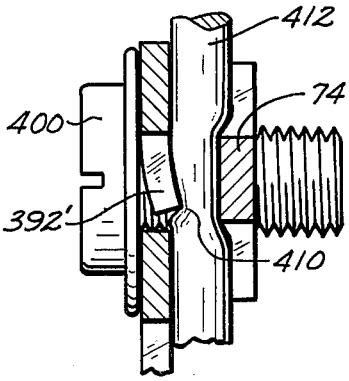
FIG. 42 is a view corresponding to FIG. 41 and showing the terminal connection tightened.

As shown at FIG. 41, a leg 392' of terminal 384 can be bent in a direction away from screw head 400 so the leg present a sharp corner 410 which projects toward conductor 412. When the terminal is tightened as shown at FIG. 42, sharp edge 410 bites into the conductor 412 and is also flattened toward screw head 400. This provides oxide breaking in addition to that attained by the sharp edges of the fingers, and also provides additional spring loading or follow which pulls nut 74 toward terminal element 394.

While some of the embodiments of the terminal connection of this invention have been shown clamping a solid conductor, and while some embodiments have been shown clamping a stranded conductor, it will be appreciated that any of the embodiments can be used to advantage with either a stranded conductor or a solid conductor. Where the conductor is a solid conductor, the adverse effects of cantilevering and offset loading of the terminal parts are substantially eliminated, since in each embodiment, a tab or finger extends around the conductor to urge the conductor inwardly toward the screw, and thus prevent the conductor from moving sideways from between the terminal parts at the connection. Spring loading assures a long lasting connection.

In the case of the stranded conductor, each embodiment insures bundling of the conductor with corresponding good interstrand contact at the connection by virtue of the camming effect of the tab and/or fingers of the terminal parts. Spring follow or resilient loading, in the case of the stranded conductor, further assures good interstrand contact and a low resistance long connection in the event of strand settling after the connection os formed.

Compared to the aforesaid and illustrated prior art terminals, the conductor compressing surfaces in accordance with this invention move in both the X and Y planes such that the X and Y dimensions decrease simultaneously causing the cross-sectional area to decrease correspondingly. This action achieves strand bundling and the continued reshaping of the clamped strands into a minimum cross-section because both the X and Y dimensions are being decreased simultaneously. Thus, the cross-section can, for a wide range of conductor diameters, be kept optimum in its geometry as it continually forms a minimum cross-sectional area about the length of stranded conductor in the terminal.

As will be apparent, by undercutting the screw means adjacent the slotted head thereof and providing some form of retention means on it, such as a ring or collar, the clamping nut may be captured on the screw between its slotted head and the retention means. The screw may also be captured by appropriately mounting the opposite end in a fixed terminal plate.

What is claimed is:

1. A conductor connecting terminal assembly comprising, a terminal element having an opening extending perpendicularly therethrough, screw means mounted axially in the opening and having a screw head at one end thereof, said screw head having a substantially flat underside of greater cross-sectional dimension than the outward surface around the opening for bearing against said outward surface, said opening having a larger cross-sectional dimension than that of adjacent portions of said screw means whereby said screw means can rotate freely with respect to said terminal element, a clamp element in opposed relation to the terminal element, said clamp element having a threaded opening aligned with the opening in said terminal element for receiving the opposite end of said screw means, said screw means having a longitudinal axis and an external thread extending from the inward surface of said terminal element around the opening to said opposite end of said screw means, said external thread engaging the thread of said threaded opening for moving the clamp element in a direction parallel to said axis toward the terminal element to clamp the bare end of a solid or multistrand conductor between opposing portions of said elements adjacent said screw thread, a unitary tab on one of said elements, said tab extending from a body portion of said one element substantially parallel to said axis to engage the other element, said other element having a body portion with at least one slot extending therethrough in the direction of movement of said clamp element, the inward opposing body portions of both of said elements adjacent the thread of said screw means having flat and parallel opposing surfaces extending perpendicular to said axis, the slot being at least partially defined by opposing side edges of said other member, said side edges extending inwardly toward said screw thread sufficiently to allow portions of the bare end of the conductor to lie transversely across at least one of said edges prior to the initial movement of the two elements towards one another, said side edges being spaced apart with slight clearances on both sides of said tab to engage and guide said tab in its movement therebetween, said tab having a sufficient length to extend between said side edges from said initial movement of said two elements toward one another, said screw thread and said side edges of said slot being located inwardly of said tab sufficiently to allow said flat surfaces of the body portions to abut flush against one another when a conductor is absent and said elements are fully closed, said tab having an inside surface formed as a smooth, continuous extension of the flat surface of the body portion of said one element bending at an acute angle from the plane of said flat surface toward said other element, said tab and said flat surfaces of said body portions coacting so that the resultant of all forces applied to the bare conductor end thereby is directed inwardly toward the screw thread, whereby all of said portions of the bare conductor end are cammed inwardly toward said screw thread in response to movement in said direction of the clamp element toward the terminal element, rotation of said screw means moving said clamp element in said direction to the final position in which the conductor end is tightly clamped between said clamp and terminal elements, the rotation of said screw thread against the surface of the conductor end cammed thereagainst abrading oxides on such surface.

2. A terminal assembly according to claim 1 wherein said other of said elements further includes, a pair of fingers projecting toward said one element and flanking said tab to define a slot therebetween, each of said fingers having a sharp inside corner formed by one of said side edges to break oxides on the conductor surface.

3. A terminal assembly according to claim 1 wherein said tab is on said clamp element, and said terminal element comprises a flat body, and wherein said side edges are generally parallel edges between which said tab extends, the corners of said side edges being sharp to break oxides on the conductor surface.

4. A terminal assembly according to claim 1 wherein one of said elements further comprises a leg bent from the material of one of said elements and projecting away from the conductor, said leg being disposed between a head portion of said screw means and a conductor clamped by the elements, tightening said conductor causing the screw head portion to resiliently deflect said leg toward the conductor thereby applying a resilient follow force to the conductor clamped between said elements.

5. A terminal assembly according to claim 1 wherein said terminal further includes, oxide breaking means on one of said elements for breaking oxide on a surface of the conductor during clamping of the conductor between said elements, to provide a good minimal resistance electrical connection.

6. A terminal assembly according to claim 5 wherein said oxide breaking means comprises at least one edge of said other element formed in part by one of said side edges, said tab driving the conductor against said one edge during clamping of the conductor between said elements.

7. A terminal assembly according to claim 5 wherein said oxide breaking means comprises at least one oxide breaking edge of said tab.

8. A terminal assembly according to claim 5 wherein said oxide breaking means comprises at least one oxide breaking edge transverse to the length of a conductor positioned between said clamp element and said terminal element.

9. A conductor connecting terminal assembly comprising, a terminal element, a clamp element in opposed relation to the terminal element, screw means for moving the clamp element toward the terminal element to clamp a conductor between said elements, a unitary tab on one of said elements, said tab originating at a body portion of said one element and extending toward the other element, surface means on one of said elements for camming a conductor positioned between said terminal element and clamp element toward said screw means in response to movement of the clamp element toward the terminal element, said surface means comprising an inside surface of said tab which extends at an acute angle with respect to the line of action of said screw means, said screw means projecting through a clearance opening in one of the elements and being threaded into an opening in the other of the elements, one of the elements comprising a pair of spaced apart fingers bent to extend at an acute angle to the line of action of the screw means and defining a slot therebetween extending to the opening through which the screw means extends, said tab having an inside surface extending at an acute angle to said screw means and extending between said fingers, said screw means moving said clamp element with respect to said terminal element in said direction to a clamped position in which the conductor is cammed toward said screw means and tightly clamped between the clamp element and the terminal element.

* * * * *